United States Patent [19]

Renjilian et al.

[11] 4,413,391

[45] Nov. 8, 1983

[54] RESIN CONTAINING TEXTILES

[75] Inventors: Armen Renjilian, Colonie; Thomas H. Curry, Clifton Park; Elizabeth Siracusano, Courtland, all of N.Y.

[73] Assignee: Albany International Corp., Albany, N.Y.

[21] Appl. No.: 404,139

[22] Filed: Aug. 2, 1982

[51] Int. Cl.[3] ..... D65N 71/00

[52] U.S. Cl. ..... 28/166; 427/389.9; 428/288; 428/359; 428/361; 428/365; 428/378

[58] Field of Search ..... 428/288, 361, 362, 375, 428/378, 396, 365, 359; 28/166; 19/66 R; 427/401, 430.1, 386, 389.9

[56] References Cited

U.S. PATENT DOCUMENTS

| | | | |
|---|---|---|---|
| 3,118,750 | 1/1964 | Dunlap et al. | 428/369 |
| 3,403,069 | 9/1968 | Benson | 428/361 |
| 3,537,880 | 11/1970 | Kuzman | 428/361 |
| 3,790,442 | 2/1974 | Ashall | 428/361 |
| 3,878,019 | 4/1975 | Chapman et al. | 428/361 |
| 4,162,190 | 7/1979 | Ashworth | 428/280 |

FOREIGN PATENT DOCUMENTS

| | | | |
|---|---|---|---|
| 54-34500 | 3/1979 | Japan | 428/361 |

*Primary Examiner*—James J. Bell

*Attorney, Agent, or Firm*—Kane, Dalsimer, Kane, Sullivan and Kurucz

[57] ABSTRACT

A method is disclosed for the manufacture of textile fabrics having resin coated components. The method comprises coating staple fibers with crosslinkable polymeric resins, forming the desired fabrics from the fibers and then cross-linking the resin coating.

2 Claims, 6 Drawing Figures

FIG.1
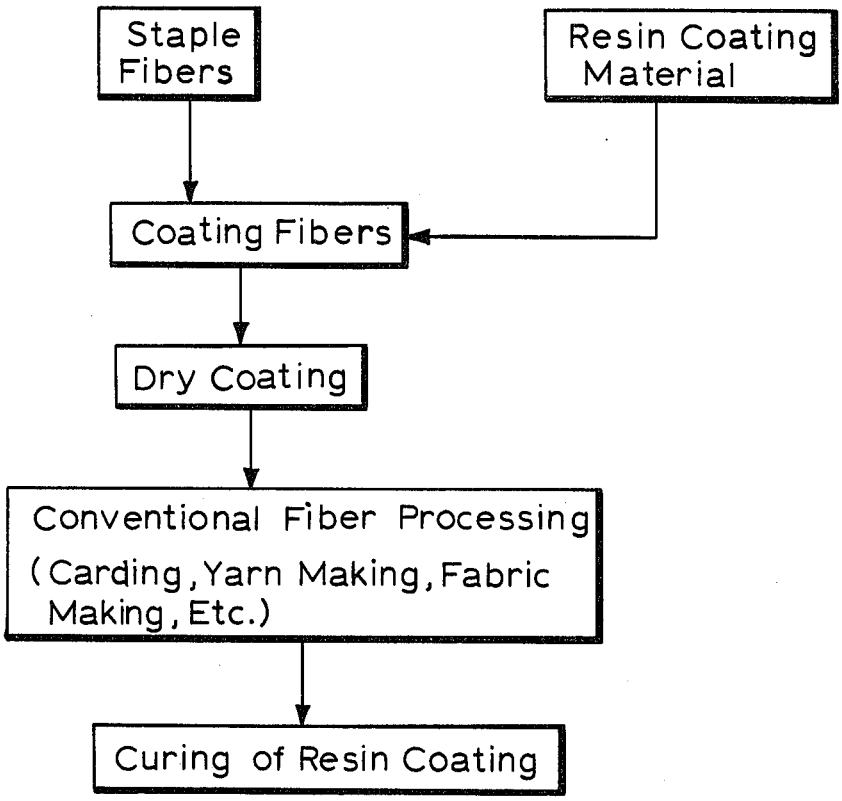
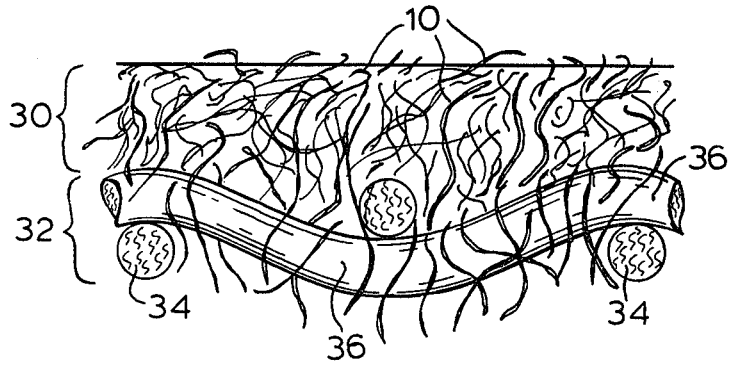
FIG.6

RESIN CONTAINING TEXTILES

BACKGROUND OF THE INVENTION

1. Field of the Invention

The invention relates to textile fabrics, components thereof and methods of their preparation and manufacture and more particularly relates to synthetic polymeric resin containing textiles.

2. Brief Description of the Prior Art

The treatment of finished woven and non-woven fabrics with synthetic, polymeric resins to improve certain physical properties and fiber surface characteristics is a common practice; see for example U.S. Pat. No. 3,118,750. However, such treatments generally result in a stiffening of the fabric, especially at high levels of resin add-on. This is due in part to the resin bonding which occurs between component yarns, fibers, etc. at their crossover sites within the body of the fabric.

By the method of this invention, resin containing fabrics may be prepared which are free of the characteristic stiffness associated with the prior art resin coated fabrics, by precoating component fibers with a non-bonding resin composition. The fabrics also exhibit improved abrasion resistance.

Representative of U.S. patents having descriptions of the prior art are U.S. Pat. Nos. 3,537,880; 3,403,069; 3,790,442; and 4,162,190.

SUMMARY OF THE INVENTION

The invention comprises a method of preparing textile fabrics from loose, staple textile fibers, which comprises; coating the fibers with a film of a synthetic, cross-linkable, polymeric resin; forming the coated fibers into a fabric form; and cross-linking the resin.

The invention also comprises the coated fibers, fabric components made therefrom and finished fabrics.

The coated fibers of the invention differ from uncoated fibers in that their diameters are altered irregularly. This alteration appears to improve the abrasion resistance, resistance to compaction and improves resiliency of fabrics wherein the fibers form a major part of the structure.

An advantage of the method of the invention is found in that virtually 100 percent of the surface area of the staple fibers are coated with resin. In contrast, impregnating a finished fabric rarely accomplishes such a complete coating of all the fiber components.

BRIEF DESCRIPTION OF THE DRAWINGS

FIG. 1 is a block diagram of an embodiment process of the invention.

FIG. 6 is a cross-sectional side elevation of an embodiment fabric of the invention.

DETAILED DESCRIPTION OF THE PREFERRED EMBODIMENTS OF THE INVENTION

Figure 3:
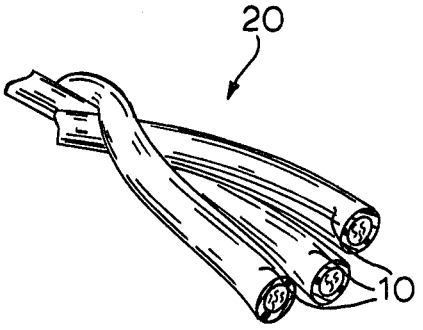
FIG. 3 is a view of a plurality of fibers as shown in FIG. 2, twisted into a yarn.

The method of the invention, as shown by the embodiment method depicted in the block diagram of FIG. 1, may be carried out as follows:

A quantity of textile staple fibers is provided for coating with a film of a synthetic, polymeric resin. Any conventional and available staple fibers may be coated including crimped and uncrimped fibers. Representative of such staple fibers are thermoplastic fibers of synthetic polymers such as polyolefins, polyesters, polyamides and like staple fibers.

There is also provided, as a coating resin, a solution or dispersion of a film-forming, synthetic, polymeric resin.

The synthetic, polymeric resin coating applied in the method of the invention is one which will, following application, dry to a tack-free state leaving a dry film which will not adhere to itself. It is also required that the dry resin film or coating be relatively flexible but transformable by chemical reaction to a relatively rigid state. The chemical reaction may be a cross-linking of the polymer. A wide variety of such polymeric resin coatings are known and many are commercially available.

Representative of crosslinkable polymeric resins are polyolefins such as polyethylene, ethylene copolymers, polypropylene, polyamides including nylons, fluorinated ethylene propylene, polyvinylchloride, polyvinylidene fluoride, acrylic polymers and the like. These crosslinkable polymeric resins may be compounded in liquid dispersions with crosslinking agents such as divinyl benzene, polybutadiene, allyl methacrylate, divinyl succinate, ethylene glycol diacrylate, diallyl fumarate, triallyl phosphate, triallyl cyanurate and the like. These crosslinking agents will react to crosslink crosslinkable polymeric resins upon exposure of the dried dispersions to electromagnetic irradiation. Heating may also be used to activate crosslinking, if the dried resin composition also includes a free radical generating compound such as an organic peroxide or the like.

A preferred class of synthetic, polymeric resin coating employed in the method of the invention are the B-stage, thermosetting resins. Representative of such resins are fusible resole resins, fusible phenol-formaldehyde resins, melamine-formaldehyde resins and the like. Upon exposure to heat, the B-stage resins are converted to the infusible C-stage, a relatively more rigid resin form.

Another preferred class of polymeric resin used in the method of the invention are linear epoxy resins which may be crosslinked by reaction with polyamines. The polyepoxide is mixed with the polyamine and solvents to prepare flexible coatings. The coatings may be hardened upon exposure to heat. Representative of such polyepoxide systems are those described in U.S. Pat. Nos. 3,280,054; 3,436,359.

Flexible coatings of hardenable polymeric resins may also be prepared from mixtures of hydroxyl-terminated polyesters and blocked polyisocyanate cross-linking agents. Upon heating, the polyisocyanate unblocks and the polyisocyanate crosslinks the polyester to harden or rigidify the coating.

Generally, the resin is provided in a solution or dispersed in a carrier, preferably aqueous. A solids content of from 5 to 50 percent is generally advantageous if its resin is provided in an aqueous dispersion, although this is not a critical requirement.

In the preferred embodiment process of the invention, the resin mixture is charged to a suitable vessel and the staple fibers are added with mixing, sufficient to cover the fiber surfaces with the resin mixture. The ratio of resin to fiber is advantageously one sufficient to provide enough resin to surface coat the fibers. Advantageously an excess of resin is employed to assist in mixing of the fibers, in the resin solution or dispersion. When resin solutions or dispersions with 5 to 50 percent by weight resin concentrations are used, the preferred ratio of solution or dispersion to fiber is about 100 lbs. of the resin mixture to about 2 to 4 lbs. (preferably 3 lbs.) of the staple fibers. However, any ratio is acceptable which promotes full surface coating of the fibers.

Following surface coating of the staple fibers with a liquid form of the resin, the coating is dried in place, employing conventional drying apparatus. The dried and coated fibers are then ready for conventional processing into webs, roving, yarns, etc. for use in the manufacture of woven, non-woven, knitted, piled and like fabrics. Since the film of resin coating the fiber body is non-bonding, i.e.; it will not stick to itself, the fibers can be processed using conventional techniques, to form the desired yarns, fabrics, etc. The yarns, fabrics and like products may then be finished by activating the resin film to cross-link (cure) and thereby rigidify the component fibers without stiffening the whole fabric to an undesired extent.

When heat is used to activate crosslinking, it is preferably done at a crosslinking temperature below the melting point of the resin from which the fiber is made.

Figure 2:
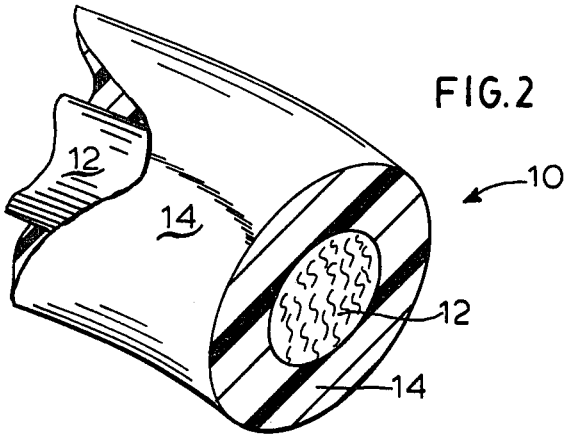
FIG. 2 is a cross-sectioned, view-in-perspective of a portion of an embodiment resin coated fiber of the invention.

FIG. 2 shows a cross-sectioned portion of a staple fiber 12, coated by the method of the invention with a film of a cross-linkable polymeric resin 14. The coated fiber 10 is relatively flexible and can be processed by conventional means, i.e.; carding, yarn making, etc. to form yarns, woven and non-woven fabrics. The film 14 is non-bonding and non-tacky. In FIG. 3, a plurality of the coated fibers 10 are being plied together to form a yarn. The plied fibers do not stick together and the fibers and yarn remains relatively resilient and flexible.

Figure 4:
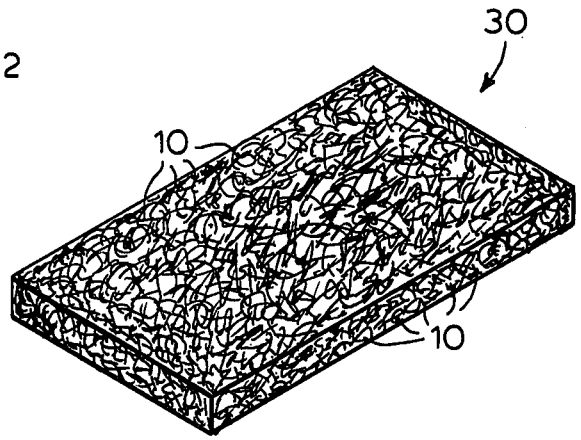
FIG. 4 is a view of an embodiment non-woven fabric of the invention.
Figure 5:
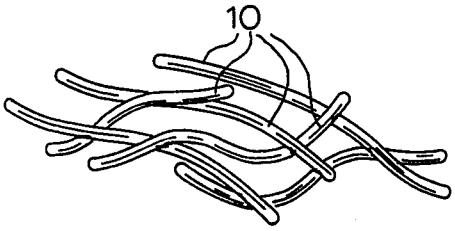
FIG. 5 is an exploded view of resin coated fibers which together make up the fabric of FIG. 4.

In FIG. 4, a plurality of the coated fibers 10 have been laid down together to form a non-woven web or batt 30. After forming batt 30, it is subjected to heat to cross-link the resin film 14. FIG. 5 is an enlarged view of some of the fibers 10 found in the structure of the batt 30 after cross-linking. The coated fibers 10, although less flexible and less resilient than before heating and cross-linking, remain free and unbonded to each other so that the batt 30 is not as stiff as it would have been if it were formed first and impregnated with a hardening resin mixture.

FIG. 6 is a cross-sectional side elevation of a portion of a papermaker's felt made from a web of fibers 10 (as described above) in layer 30 needled to a woven scrim 32 of machine direction yarns 34 and cross-machine direction yarns 36. The fibers 10 are not bonded to each other by the resin coating. Needling does not break the fibers 10 which, although resin coated, remain relatively flexible and mobile during needling. Following needling, the resin is cross-linked to rigidify the fibers, but without destroying the desired resiliency of the whole fabric. The cross-linked, resin coated fibers do not bond together at cross-over sites during cross-linking.

The following examples describe the manner and the process of making and using the invention and set forth the best mode contemplated by the inventors of carrying out the invention but are not to be considered limiting.

EXAMPLE 1

An 18 percent by weight solution (dispersion) of a B-stageable epoxy resin (PC 2737, Polyset Chemicals, Round Lake, N.Y.) in water was prepared and 1,000 lbs. of the dispersion charged to the vessel of a centrifuge extractor. To the charge there was added with gentle stirring, 30 lbs. of Nylon 66 (15 denier) staple fibers which were previously picked (fluffed). After the fibers were completely soaked and covered with the solution (dispersion) they were spin-dried in the centrifuge-extractor to a 50 percent wet pickup, transferred to a tumbler type of dryer and dried at a temperature of 200° F.

The dried fibers were carded and formed into a non-woven web, employing conventional web forming techniques. The webs exhibit improved abrasion resistance over untreated webs of the same staple fibers.

The procedure of Example 1, supra., was repeated three times except that in place of 15 denier fibers, there was used 6 denier Nylon 66 staple fibers and in place of the 18 percent by weight solution, a 6 percent by weight solution of the expoxy resin was used in one run, a 12 percent solution in another run and a 0 percent solution was used in a third (control) run. The non-woven webs obtained were all similar in weight, caliper and initial void fraction. However, under compression testing (500 cycles) it was seen that the 6 percent epoxy coated fibrous webs exhibited a higher void fraction than the uncoated fibrous webs (control) and the 12 percent epoxy coated fibrous webs maintained a higher void fraction than the 6 percent run.

Percent void volume under compression after 500 cycles of compression is indicative of the behavior of a "broken in" papermakers' felt in the nip of a paper machine. A felt that is able to maintain a higher void fraction (% void volume) under compression will remain more open in the nip of a paper machine and will be able to handle more water. It can also be run with a higher roll loading and still maintain its openness. This would indicate that papermakers' felts made with epoxy treated fibers will remain more open and be able to handle more water in the nip of a paper machine than felts manufactured with nontreated fibers. The compression testing of the webs as described above indicates that the method of the invention is particularly useful to provide non-woven fabric components for a papermakers' felt.

Many modifications may be made to the above-described preferred embodiments of the invention without departing from the spirit and the scope of the invention. For example, the coated fibers of the invention may be treated with lubricants, water-repellants and the like prior to or after cross-linking of the resin coating.

What is claimed:

1. A method of preparing textile fabrics from loose, staple textile fibers, which comprises;

coating the fibers with a film of a synthetic, cross-linkable, polymeric resin, said resin being one which will, following application, dry to a tack-free state which will not adhere to itself;

drying the film so that it is tack-free and will not adhere to itself;

forming the coated fibers bearing dry film into a fabric form; and cross-linking the resin whereby the coated fibers in the fabric form remain unbonded to each other.

2. The method of claim 1 wherein the resin is a B-stage resin and cross-linking is by heating.

* * * * *